US008256759B2

(12) United States Patent
Dobashi

(10) Patent No.: US 8,256,759 B2
(45) Date of Patent: Sep. 4, 2012

(54) SHEET POST-PROCESSING APPARATUS WITH PROTECTION COVER

(75) Inventor: Shouichi Dobashi, Izunokuni (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/962,080

(22) Filed: Dec. 7, 2010

(65) Prior Publication Data

US 2011/0074083 A1 Mar. 31, 2011

Related U.S. Application Data

(60) Continuation of application No. 12/769,083, filed on Apr. 28, 2010, now Pat. No. 7,866,646, and a division of application No. 11/739,158, filed on Apr. 24, 2007, now Pat. No. 7,734,217.

(51) Int. Cl.
*B65H 39/00* (2006.01)

(52) U.S. Cl. ..... 270/58.18; 270/58.28

(58) Field of Classification Search ..... 270/58.01, 270/58.18, 58.28

See application file for complete search history.

(56) References Cited

U.S. PATENT DOCUMENTS

| | | | | |
|---|---|---|---|---|
| 4,523,831 | A | 6/1985 | Yokoo et al. | |
| 4,801,133 | A | 1/1989 | Ishiguro et al. | |
| 6,824,128 | B2 * | 11/2004 | Nagata et al. | 270/58.08 |
| 7,284,752 | B2 * | 10/2007 | Nagata et al. | 270/58.18 |
| 7,328,894 | B2 * | 2/2008 | Terao et al. | 270/58.15 |
| 2005/0141916 | A1 | 6/2005 | Arimitsu et al. | |
| 2006/0180586 | A1 | 8/2006 | Yasuda et al. | |
| 2007/0235917 | A1 * | 10/2007 | Nagasako et al. | 270/58.08 |

OTHER PUBLICATIONS

Office Action for U.S. Appl. No. 11/739,158 mailed on Apr. 1, 2009.

* cited by examiner

*Primary Examiner* — Leslie A Nicholson, III
(74) *Attorney, Agent, or Firm* — Turocy & Watson, LLP

(57) ABSTRACT

A sheet post-processing apparatus of the invention includes a sheet guiding unit configured to have plural components including paper carrying components be attached thereto, a tray onto which a sheet of paper is discharged, and a protection cover attached to the sheet guiding unit at a portion in close proximity to the tray side. A protection cover has a cover main body, a screw attachment portion, a screw cover that covers the screw attached to the screw attachment portion, and a slit used for the tip end of the screw cover to be inserted into the cover main body to be fixed thereto.

11 Claims, 8 Drawing Sheets

SHEET POST-PROCESSING APPARATUS WITH PROTECTION COVER

CROSS REFERENCE TO RELATED APPLICATION

This application is a Continuation of application Ser. No. 12/769,083 filed on Apr. 28, 2010, which is a Division of application Ser. No. 11/739,158 filed on Apr. 24, 2007, the entire contents of both of which are incorporated herein by reference.

BACKGROUND OF THE INVENTION

1. Field of the Invention

The present invention relates to a sheet post-processing apparatus that performs post-processing on sheets of paper discharged from an image forming apparatus, such as a copying machine, a printer, and a multi-function peripheral, and a protection cover device used therein.

2. Description of the Related Art

Recently, there is an image forming apparatus of a type in which a sheet post-processing apparatus is provided adjacently to a paper discharge unit of the image forming apparatus main body to perform post-processing on sheets of paper, for example, sorting or staple processing on sheets of paper after image formation.

U.S. Pat. No. 4,801,133 describes a sheet processing apparatus that activates the image forming apparatus main body and the staple processing unit in cooperation with each other. This sheet processing apparatus has a switching member that carries a sheet of paper to different carrying paths when post-processing is necessary and when post-processing is unnecessary.

However, with the sheet post-processing apparatus described in this reference, a sheet of paper gets jammed in the carrying path, that is, an event so-called paper jamming, occurs occasionally and it is not easy for the user to remove paper jamming. In addition, when the user inserts his finger into a machine portion of the sheet post-processing apparatus to remove paper jamming, there is a possibility of injury to the finger as it is caught on a protrusion, such as a screw.

The invention provides a sheet post-processing apparatus enabling jamming to be removed when paper jamming occurred and capable of preventing injury when the user inserts his finger into the machine portion and a protection cover.

DETAILED DESCRIPTION OF THE INVENTION

Figure 1:
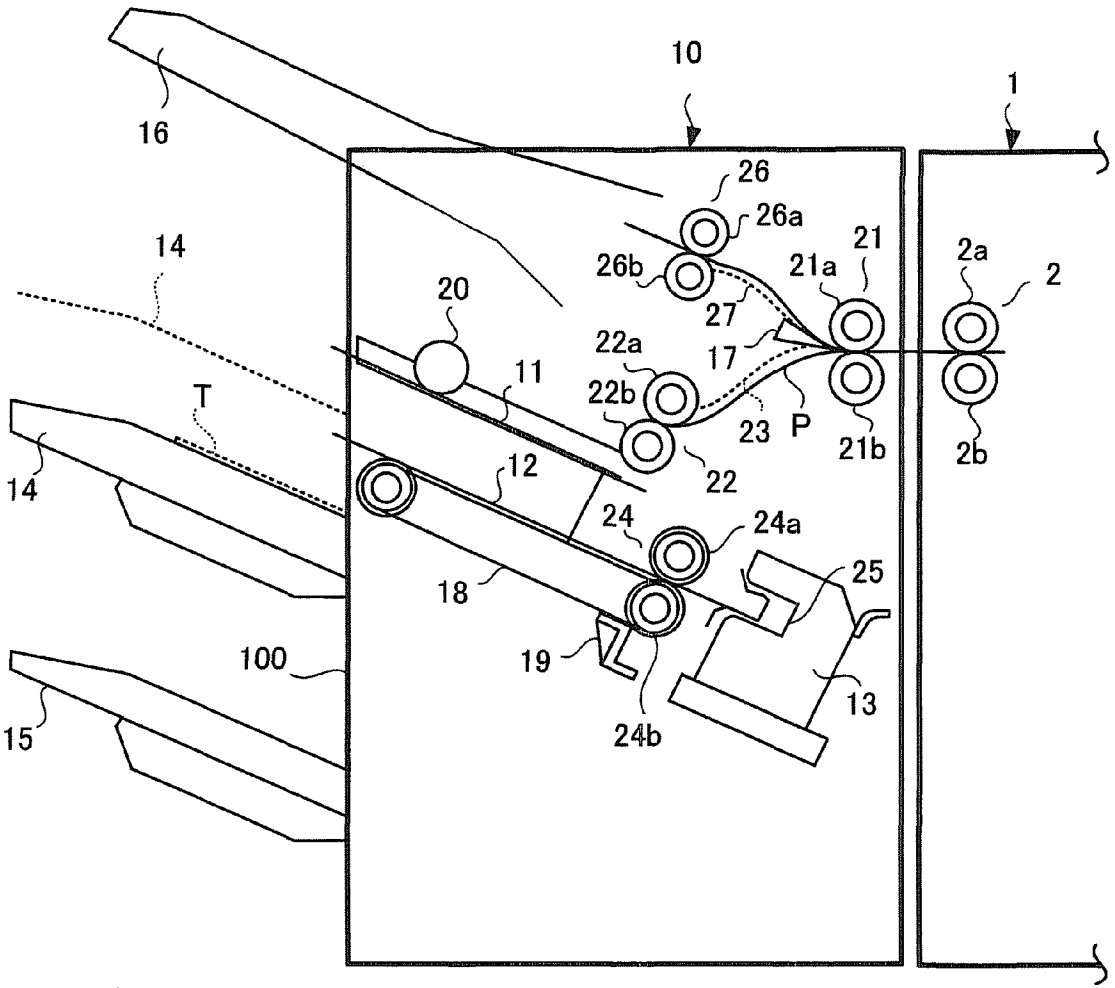
FIG. 1 is a view schematically showing the configuration of a sheet post-processing apparatus according to one embodiment of the invention.

Throughout this description, the embodiments and examples shown should be considered as exemplars, rather than limitations on the apparatus of the present invention.

Hereinafter, one embodiment of the invention will be described in detail with reference to the drawings. In the respective drawings, like components are explained with like reference numerals.

FIG. 1 is a view schematically showing the configuration of a sheet post-processing apparatus 10 disposed adjacently to an image forming apparatus 1, such as a copying machine. A sheet of paper P on which is formed an image by the image forming apparatus 1 is discharged from a paper discharge roller 2 and carried into the sheet post-processing apparatus 10. The paper discharge roller 2 is formed of a top roller 2*a* and a bottom roller 2*b*.

The sheet post-processing apparatus 10 has a stand-by tray 11, a processing tray 12, a stapler 13, a first paper discharge tray 14, a second paper discharge tray 15, a fixed tray 16, and a gate 17.

A sheet of paper P discharged by the paper discharge roller 2 in the image forming apparatus 1 is received at inlet rollers 21 provided in the vicinity of a carrying-in port of the sheet post-processing apparatus 10. Each inlet roller 21 is formed of a top roller 21*a* and a bottom roller 21*b* and driven by a motor (not shown).

The gate 17 that branches a path for the sheet of paper P received at the inlet rollers 21 to two paths is provided downstream from the inlet rollers 21. The gate 17 has a wedge-shaped cross section and a pointed portion in the shape of wedge is orientated in the direction of the inlet rollers 21. The gate 17 is attached to the interior of the sheet post-processing apparatus 10 in a rotatable manner. The pointed portion of the gate 17 rotates between a first position pointing to the top rollers 21*a* and a second position pointing to the bottom rollers 21*b*.

In other words, the first position is for the case to choose a path when post-processing is necessary for the sheet of paper P and the second position is for the case to choose a path when post-processing is unnecessary for the sheet of paper P.

When the gate 17 is at the first position, the sheet of paper P is supplied to paper feeding rollers 22 and is sent to the stand-by tray 11 from the paper feeding rollers 22. A paper path 23 to guide the sheet of paper P to the paper feeding rollers 22 is provided from the inlet rollers 21 to the stand-by tray 11. Each paper feeding roller 22 is formed of a top roller 22*a* and a bottom roller 22*b*.

The stand-by tray 11 is of a structure to stack sheets of paper P thereon and to be openable. When a predetermined number of sheets of paper P are stacked thereon, the stand-by tray 11 opens, and the sheets of paper P drop onto the processing tray 12 due to their own weights. The processing tray 12 to stack thereon the sheets of paper P dropped from the stand-by tray 11 is disposed below the stand-by tray 11. The processing tray 12 aligns and supports the sheets of paper P while the stapler 13 serving as a post-processing mechanism staples the sheets of paper P.

The sheets of paper dropped onto the processing tray 12 are guided to the stapler 13 by rollers 24 to be subjected to staple processing. Each roller 24 is formed of a top roller 24*a* and a bottom roller 24*b*.

Plural sheets of paper P dropped from the stand-by tray 11 are subjected to the staple processing after they are aligned in the portrait direction which is the carrying direction and also in the landscape direction orthogonal to the carrying direction. A description of alignment means is omitted herein.

A stopper 25 that limits the rear-end position of the sheets of paper P is provided to the processing tray 12 at the end portion on the stapler 13 side. Also, a carrying belt 18 that carries a bundle of sheets of paper, T, done with the staple processing to the first paper discharge tray 14 or the second paper discharge tray 15 is provided. A claw member 19 that sends the bundle of sheets of paper, T, by hooking the rear end thereof is attached to the carrying belt 18. The carrying belt 18 is driven by the rollers 24. The rollers 24 rotate inversely when they guide aligned sheets of paper to the stapler 13 and when they discharge the bundle of sheets of paper, T, done with the staple processing.

The bundle of sheets of paper, T, carried by the carrying belt 18 is discharged onto the first paper discharge tray 14 or the second paper discharge tray 15, and the first paper discharge tray 14 and the second paper discharge tray 15 are moved up or down by driving units (not shown) to receive the bundle of sheets of paper, T.

There is a case where sheets of paper P stacked on the stand-by tray 11 are discharged onto the first paper discharge tray 14 or the second paper discharge tray 15 without the staple processing. In this case, the sheets of paper P are discharged by rollers 20 without being dropped onto the processing tray 12.

In addition, sheets of paper P that do not require post-processing can be discharged onto the fixed tray 16. More specifically, when the gate 17 is at the second position, a sheet of paper P is supplied to paper feeding rollers 26. Each paper feeding roller 26 is formed of a top roller 26*a* and a bottom roller 26*b* and guides a sheet of paper P through the path branched at the gate 17 to the fixed tray 16. A sheet of paper P carried via the paper feeding rollers 26 is discharged onto the bottom portion 16*a* of the tray from a discharge port made in the tray 16.

A paper path 27 to guide a sheet of paper P to the paper feeding rollers 26 is provided, and the fixed tray 16 is attached to the top surface of the main body unit 100 of the sheet post-processing apparatus 10 in an openable and closable manner.

Figure 2:
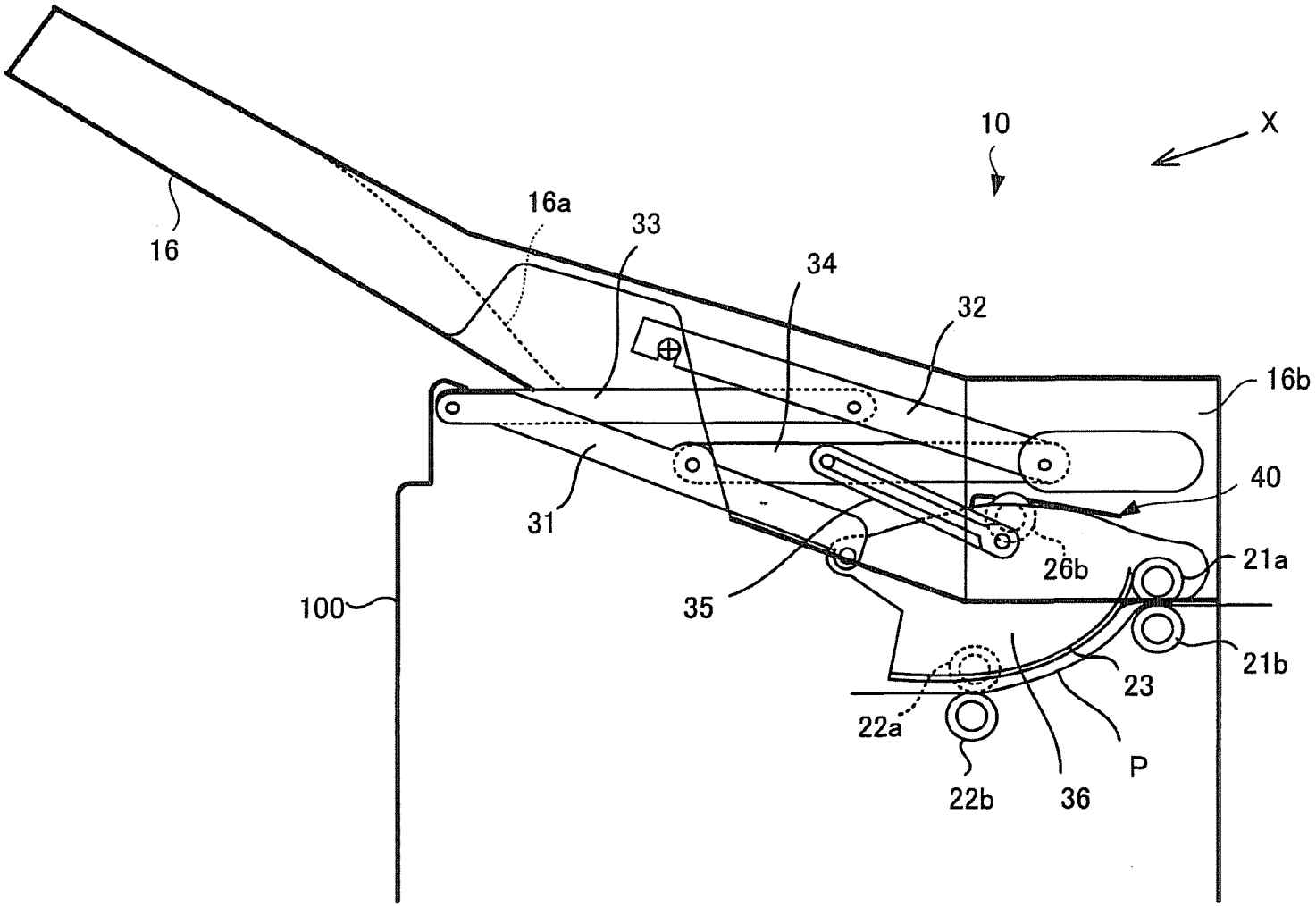
FIG. 2 is an explanatory view of a jamming processing mechanism in the sheet post-processing apparatus according to one embodiment of the invention.

FIG. 2 shows a jamming processing mechanism and chiefly shows the opening and closing structure of the fixed tray 16.

Referring to FIG. 2, the fixed tray 16 has the bottom surface 16*a* to receive discharged sheets of paper and side walls 16*b*. A first fixing member 31 is attached in a slanting position on the top portion of the main body 100 of the sheet post-processing apparatus 10. Second fixing members 32 are attached in a slanting position to the side walls 16*b* of the fixed tray 16.

A first linking member 33 links the upper end of the first fixing member 31 and the intermediate portion of each second fixing member 32 and a second linking member 34 links the intermediate portion of the first fixing member 31 and the lower end of each second fixing member 32. The first and second linking members 33 and 34 form parallel links and they are disposed for the first fixing member 31 and the second fixing members 32 to be parallel to each other at a specific interval.

One end of a coupling link 35 is coupled to the intermediate portion of each link member 34 in a rotatable manner, and the other end of the coupling link 35 is coupled to a sheet guiding unit 36 in a rotatable manner. The paper path 23 is attached to the sheet guiding unit 36 and the sheet guiding unit 36 is supported on the lower end of the first fixing member 31 in a rotatable manner.

Also, the sheet guiding unit 36 supports the top rollers 21*a* of the inlet rollers 21 and the top rollers 22*a* of the paper feeding rollers 22, and further supports the bottom rollers 26*b* of the paper feeding rollers 26.

Figure 3:
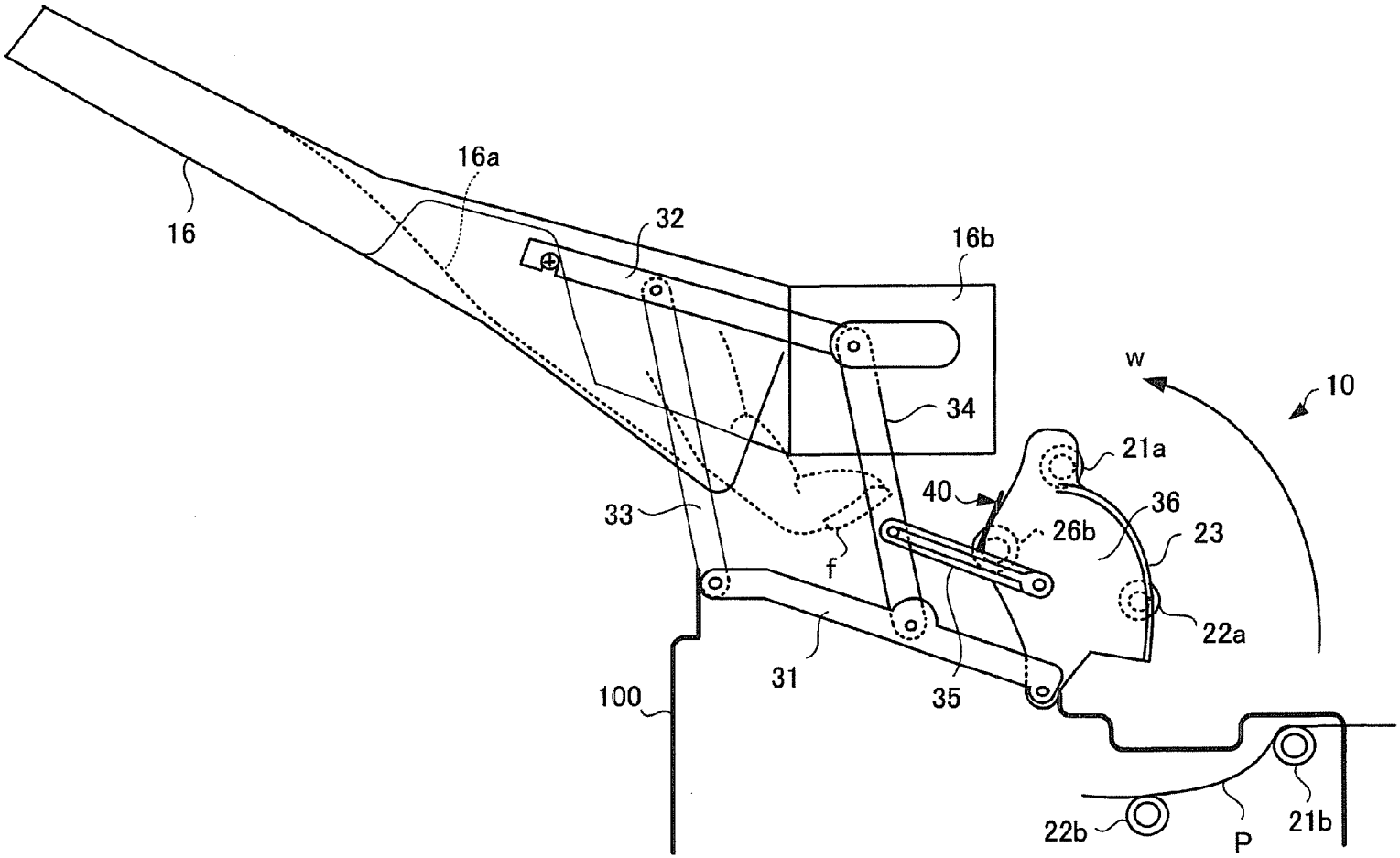
FIG. 3 is a view used to describe an operation of the jamming processing mechanism in the sheet post-processing apparatus according to one embodiment of the invention.

An action to be taken at the occurrence of paper jamming in the paper carrying path will now be described with reference to FIG. 3. FIG. 3 shows a state where the fixed tray 16 is opened at the occurrence of jamming. More specifically, at the occurrence of jamming, the fixed tray 16 is allowed to rotate from a closed state in FIG. 2 (the lower position) in the direction indicated by an arrow w of FIG. 3, so that the first and second linking members 33 and 34 rotate in an almost vertical direction, which causes the fixed tray 16 to move up. A motion that the fixed tray rotates and moves up is referred to as "open" in the description below.

The coupling links 35 are pulled in association with the rotations of the second linking members 34, which causes the sheet guiding unit 36 to standup in the vertical direction at the same time. As the sheet guiding unit 36 opens, the top rollers 21*a* and the bottom rollers 21*b* as well as the top rollers 22*a* and the bottom rollers 22*b* are spaced apart from the corresponding counterparts. The carrying path of a sheet of paper P is thus exposed, and even when a sheet of paper gets jammed between the inlet rollers 21 and the paper feeding rollers 22, it is easy to take out the jammed sheet of paper.

A damper mechanism is provided to avoid an abrupt opening operation of the fixed tray 16, which is, however, omitted in the drawing. Also, although a locking mechanism functions when the fixed tray 16 is closed, the lock can be released at the occurrence of paper jamming to allow the fixed tray 16 to be opened.

In this embodiment configured as has been described, in the event of the occurrence of paper jamming, the user is able to remove a jammed sheet of paper with ease by opening the fixed tray 16.

Figure 4:
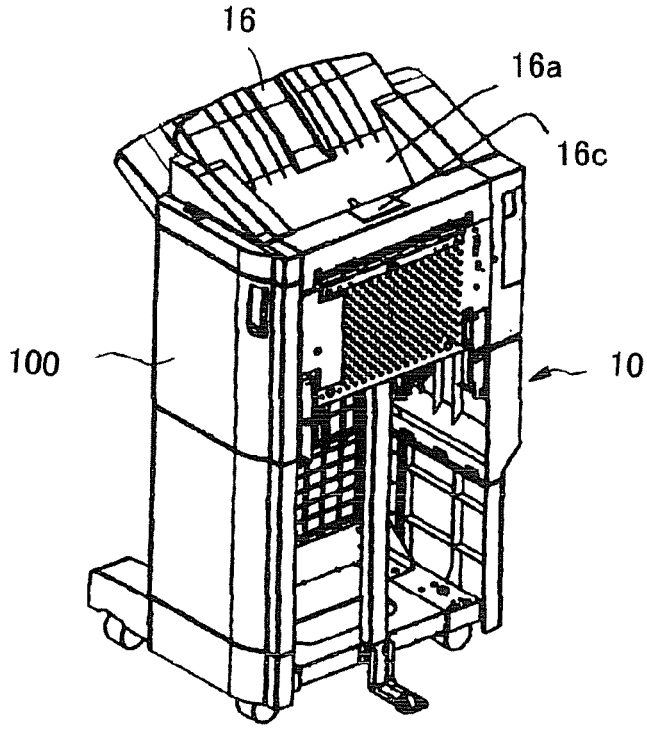
FIG. 4 is a perspective view of the sheet post-processing apparatus according to one embodiment of the invention.
Figure 5:
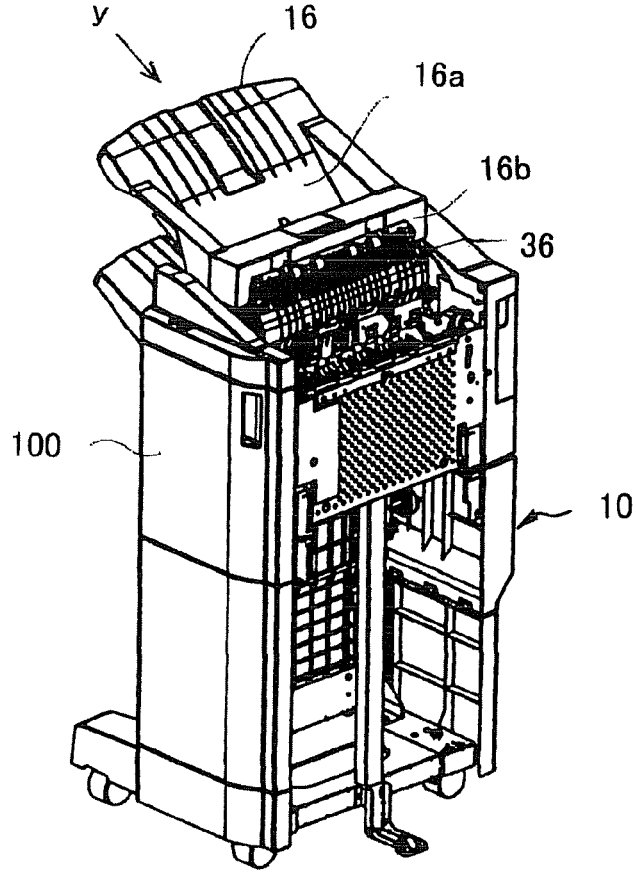
FIG. 5 is a perspective view of the sheet post-processing apparatus according to one embodiment of the invention to show a state where a fixed tray is opened.

FIG. 4 is a schematic view of the sheet post-processing apparatus 10 when viewed in the direction indicated by an arrow X of FIG. 2. The fixed tray 16 is in a closed state. Also, FIG. 5 is a schematic view of the sheet post-processing apparatus 10 and shows a state where the fixed tray 16 is opened.

As is shown in FIG. 4, a lever 16*c* is provided on the top surface of the fixed tray 16, and when the lever 16*c* is pulled upward, the locking mechanism is released, which allows the fixed tray 16 to open in the direction indicated by the arrow w. When the fixed tray 16 is opened, the sheet guiding unit 36 rotates in the vertical direction at the same time owing to the coupling links 35 (see FIG. 3).

Incidentally, while the fixed tray 16 is opened, as is shown in FIG. 3, the user can insert his finger f inside from above the fixed tray 16. When he closes the fixed tray 16 while the finger f is inserted inside, there is a possibility that the finger f is caught between components forming the sheet guiding unit 36. The user has to be particularly careful when there is a protrusion, such as a screw.

The invention therefore provides protection covers 40. The protection covers 40 according to one embodiment of the invention will be described with reference to FIG. 6 and FIG. 7.

Figure 6:
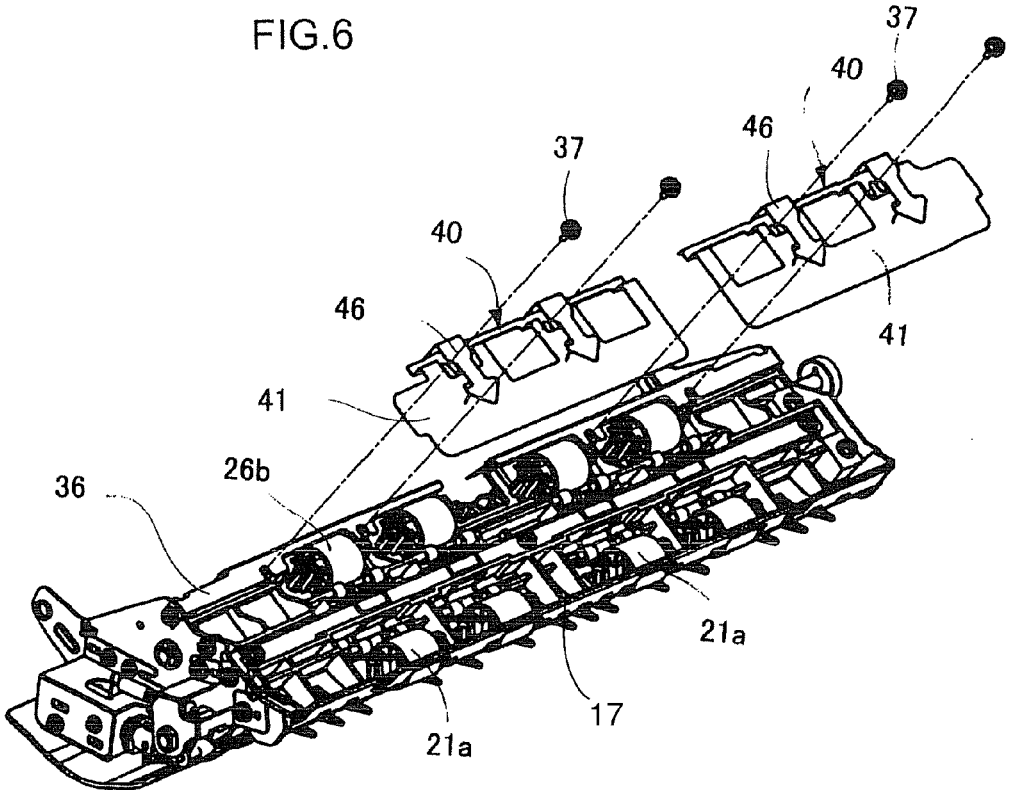
FIG. 6 is a perspective view of protection covers according to one embodiment of the invention to show a case where they are to be attached to a sheet guiding unit.
Figure 7:
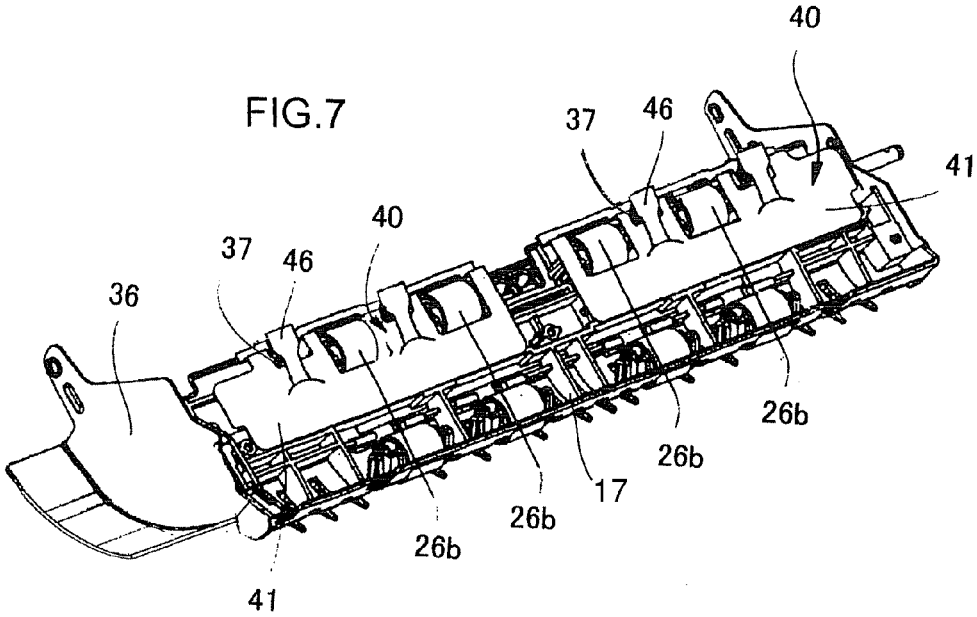
FIG. 7 is a perspective view of the protection covers according to one embodiment of the invention when they are attached to the sheet guiding unit.

FIG. 6 shows the structures of the protection covers 40 and the sheet guiding unit 36. A gate 17 is disposed on the sheet guiding unit 36. The protection covers 40 are fastened to the sheet guiding unit 36 with screws 37 and thereby cover part of the components provided to the sheet guiding unit 36. FIG. 7 shows a state where the protection covers 40 are attached to the sheet guiding unit 36. In order to show the structure of the end portion of the sheet guiding unit 36, components present at the end portion of the sheet guiding unit 36 are omitted from FIG. 7.

Each protection cover 40 is attached to the sheet guiding unit 36 by a double-faced adhesive tape and the screws 37. The main body 41 of the protection cover 40 covers the components of the sheet guiding unit 36 and covers the screws 37 using screw covers 46. Because the top parts of the screws 37 become protrusions, the screws 37 are covered with the screw covers 46. Hence, as is shown in FIG. 3, even when the finger f is inserted inside, the finger f is protected by the protection covers 40 and will never directly touch the screws 37 or other components.

Figure 8:
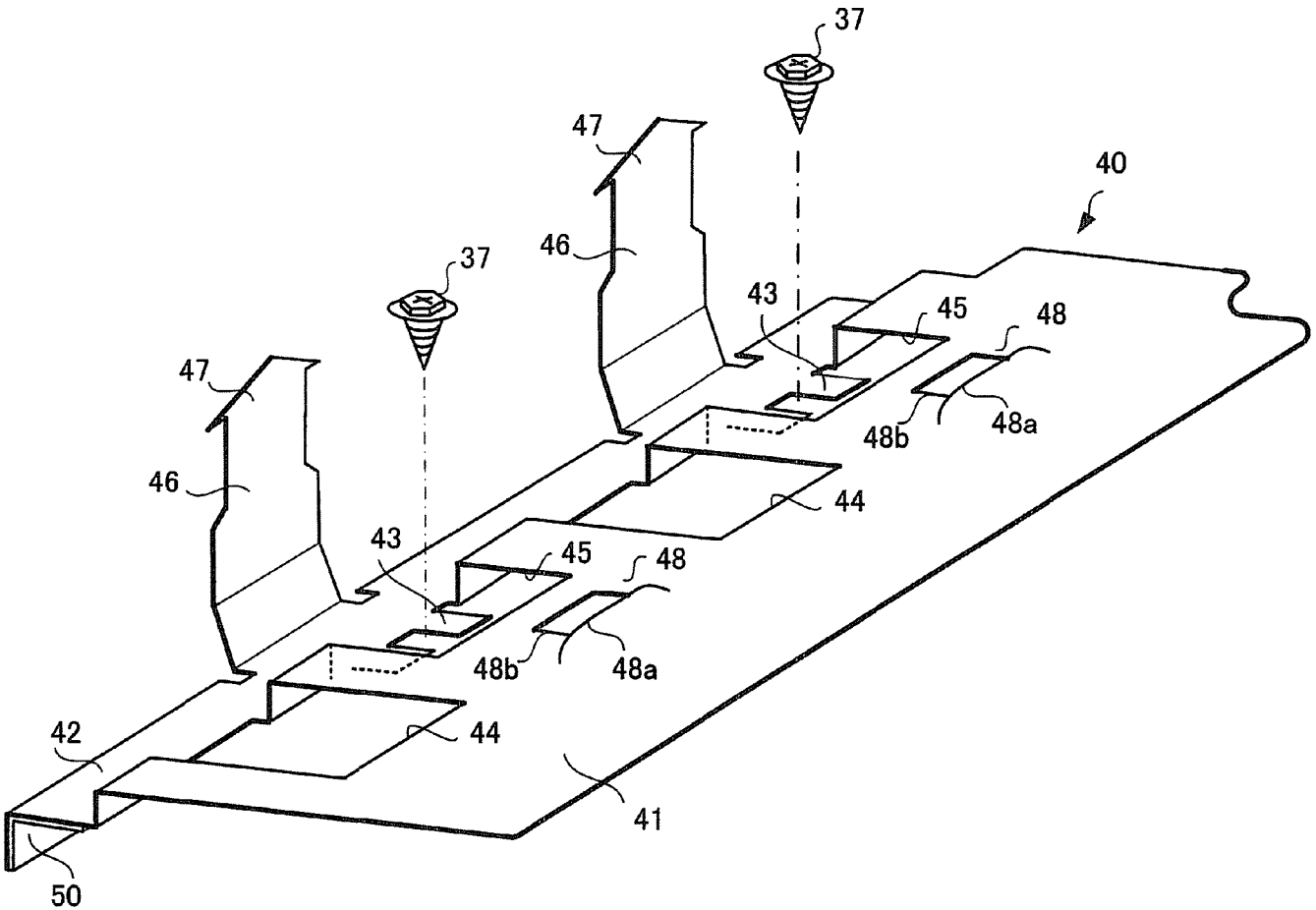
FIG. 8 is a perspective view showing the protection cover according to one embodiment of the invention.

FIG. 8 is an enlarged perspective view of the protection cover 40. The protection cover 40 is formed of a sheet of synthetic resin and one end 42 of the main body 41 is folded step-wise. A double-faced adhesive tape 50 is laminated to the inner side of the folded portion. It also has screw attachment portions 43 at the one end 42 side. The main body 41 of the protection cover 40 covers the components of the sheet guiding unit 36, and opening portions 44 are made therein at portions corresponding to the paper feeding rollers 26*b*, so that the paper feeding rollers 26*b* will not be covered.

Notches 45 are made in the main body 41 at portions opposing the screw attachment portions 43. By inserting the screws 37 through these notches 45, it is possible to fix the screw attachment portions 43 to the sheet guiding unit 36. Further, the screw covers 46 are formed to extend from the one end 42 of the protection cover 40 so as to cover the screw attachment portions 43.

The tip end portion 47 of each screw cover 46 has an arrowhead shape. By folding the screw covers 46 and inserting the tip end portions 47 into slits 48 made in the main body 41, the screw covers 46 can cover the screws 37. Because the tip end portions 47 of the screw covers 46 have the arrowhead shape, the screw covers 46 are structured in such a manner that once they are inserted into the slits 48, they will not fall out easily. Each slit 48 is formed of a C-type slit 48*a* and a guiding slit 48*b* continuing thereto.

Figure 9:
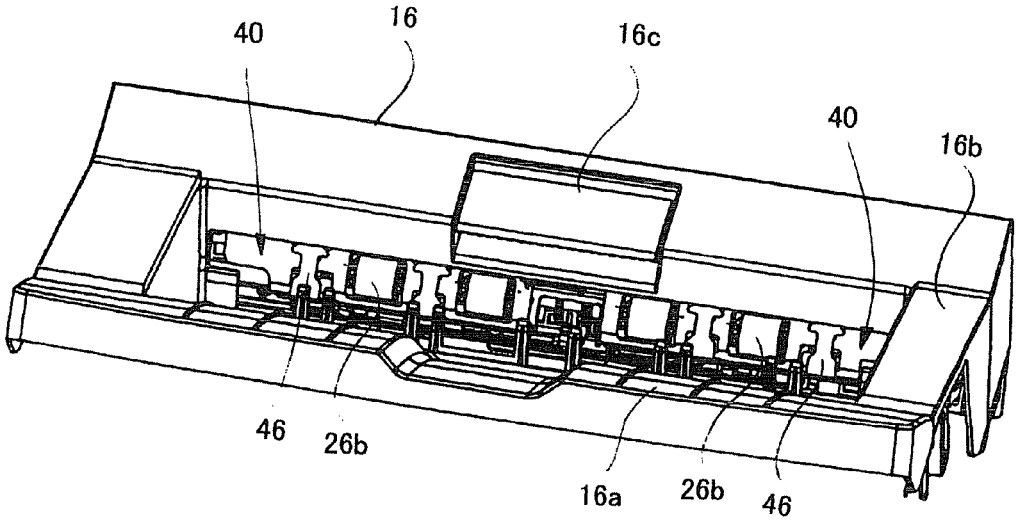
FIG. 9 is a perspective view of the protection cover according to one embodiment of the invention to show an attached state when viewed from the fixed tray side.

FIG. 9 is a perspective view of the protection covers 40 showing a state where they are attached to the sheet guiding unit 36 when viewed from the fixed tray 16 side. This is a view when viewed from the direction indicated by an arrow y of FIG. 5.

Figure 10A:
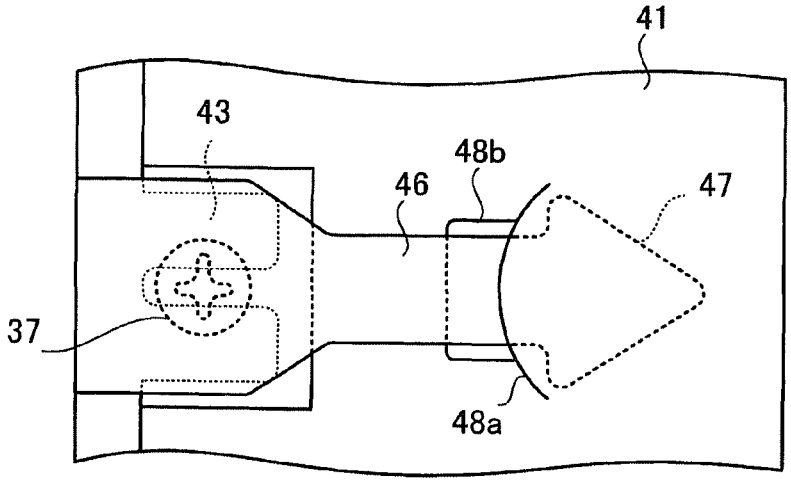
FIG. 10A is a plan view of the protection cover according to one embodiment of the invention in an attached state.
Figure 10B:
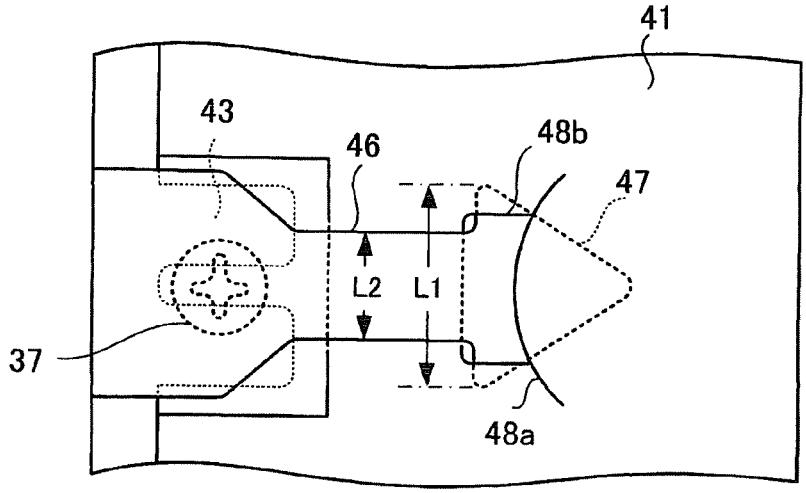
FIG. 10B is a plan view used to describe an operation when attaching the protection cover according to one embodiment of the invention.
Figure 10C:
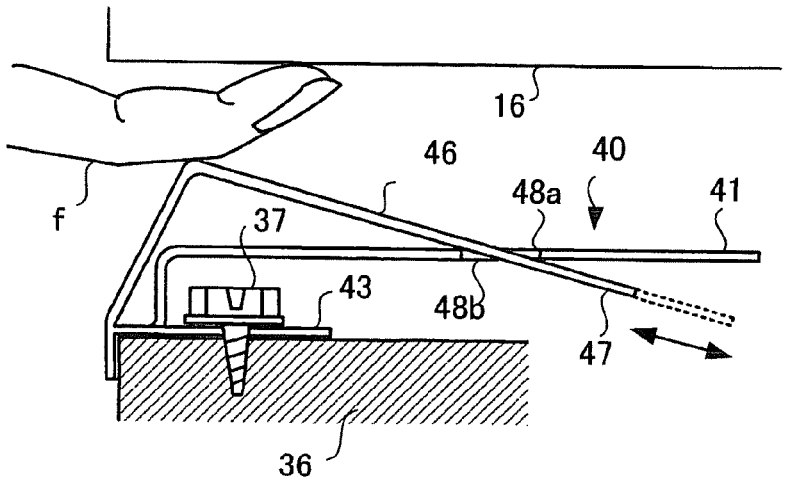
FIG. 10C is a side view used to describe an operation when attaching the protection cover according to one embodiment of the invention.

FIG. 10A and FIG. 10B are plan views showing a state where the protection cover 40 covers the screw 37. FIG. 10C is a side view showing a state where the protection cover 40 covers the screw 37.

The screw attachment portion 43 of the protection cover 40 is fastened to the sheet guiding unit 36 with the screw 37 and the screw cover 46 is folded to cover the screw 37 to insert the tip end portion 47 thereof into the guiding slit 48*b*. The tip end portion 47 is then inserted into the inner side of the C-type slit 48*a* and the screw cover 46 covers the screw 37.

As is shown in FIG. 10B, once the screw cover 46 is inserted into the slit 48, the tip end portion 47 having the arrowhead shape hooks into the guiding slit 48*b* when the user tries to pull it out from the slit 48 and it will not fall out readily. This is because the width L1 of the tip end portion 47 having the arrowhead shape is set wider than the width L2 of the guiding slit.

Also, as is shown in FIG. 10C, in a case where the finger f is inserted into a space between the fixed tray 16 and the sheet guiding unit 36, because the screw 37 is covered with the screw cover 46, the finger f will never directly touch the screw 37. In addition, it is structured in such a manner that when the finger f is inserted into the space, the screw cover 46 is pushed in the direction of the tip end portions 47 having the arrowhead shape and returns to the original position when the finger f is pulled out.

Hence, because the screw covers 46 have elasticity, there is no possibility of injury caused by the screw covers 46 in a case where the finger f is inserted into the space or when the finger f is pulled out. In addition, because the finger will never be caught on the screw covers 46, the double-faced adhesive tape 50 will not be peeled off.

As has been described, the invention can provide a sheet post-processing apparatus enabling the jamming to be removed in the event of the occurrence of paper jamming and capable of preventing injury when the user inserts his finger into a machine portion and the protection covers.

Besides the sheet guiding unit 36, the protection covers 40 may be attached to another machine components, and in a case where there are protrusions, such as screws and vises, in a space large enough for the finger to be inserted, it is possible to protect the finger by covering these protrusions. In other words, the protection covers can be used in a structure in which a first member and a second member are disposed oppositely with a specific distance therebetween and thereby define a narrow space large enough for the finger to be inserted.

In the invention, the staple processing was described as the post-processing on sheets of paper. The post-processing, however, is not limited to the staple processing, and for example, the post-processing may be hole punching (perforation) processing on sheets of paper. In this case, plural sheets of paper are not necessarily staked on the processing tray, and there is no problem when only a single sheet of paper is placed thereon. Also, the invention can achieve the advantage for a post-processing apparatus having a post-processing mechanism configured as described above.

Although exemplary embodiments of the present invention have been shown and described, it will be apparent to those having ordinary skill in the art that a number of changes, modifications, or alternations to the invention as described herein may be made, none of which depart from the spirit of the present invention. All such changes, modifications, and alternations should therefore be seen as within the scope of the present invention.

What is claimed is:

1. A sheet finishing apparatus, comprising:

a main body of the sheet finishing apparatus provided adjacent to an image forming apparatus;

a carry-in port from which a sheet is carried in;

a fixed tray that receives the sheet discharged from the main body at a fixed position;

a moveable tray that moves up and down and receives the sheets discharged from the main body, wherein the moveable tray is underneath the fixed tray;

a gate diverting and conveying the sheet, which is carried in from the carry-in port, to the fixed tray or the moveable tray;

a conveying path configured to convey the sheet toward the fixed tray, the conveying path having a first paper feeding roller pair including a first roller and a second roller, provided downstream of the gate;

a sheet guidance member capable of pivoting, and is configured to support one roller of the first paper feeding roller pair;

an upper cover member present above the main body including a lever for opening and closing, configured to cover the conveying path and the sheet guidance member;

a coupling link connected to both the sheet guidance member and the upper cover member; and the sheet guidance member is erected in a vertical direction in response to the upper cover member pivoting upwards, the coupling link transfers movement of the upper cover member to the sheet guidance member.

2. The sheet finishing apparatus according to claim 1, wherein the sheet guidance member is provided under the fixed tray.

3. The sheet finishing apparatus according to claim 1, wherein the coupling link includes:

a link member configured to pivot in the vertical direction according to pivoting of the upper cover member; and a connection member configured to connect the sheet guidance member and the link member.

4. The sheet finishing apparatus according to claim 3, wherein the link member faces a horizontal direction when the sheet guidance member is closed and faces the vertical direction when the sheet guidance member is opened.

5. The apparatus according to claim 1, further comprising a second paper feeding roller pair configured to convey the sheet toward only the moveable tray, the second paper feeding roller pair including a third roller and a fourth roller contact with the third roller, the third roller is supported to the sheet guidance member, and the third roller and the fourth roller separate from each other according to a pivoting of the sheet guidance member.

6. The apparatus according to claim 5, further comprising:

an inlet roller pair configured to convey the sheet toward the fixed tray or the moveable tray, the inlet roller pair including a first inlet roller and a second inlet roller contact with the first inlet roller, the first inlet roller is supported by the sheet guidance member, and the first inlet roller and the second inlet roller separate from each other according to a pivoting of the sheet guidance member.

7. The apparatus according to claim 1, further comprising:

a protection cover attached to the sheet guidance member, the protection cover that covers components disposed around the one roller provided to the sheet guidance member.

8. The apparatus according to claim 1, wherein the sheet guidance member is located between the fixed tray and the moveable tray.

9. The apparatus according to claim 1, further comprising a second sheet conveying path that conveys a sheet to the moveable tray, the sheet guidance member opens the second sheet conveying path in response to the sheet guidance member being erected.

10. The apparatus according to claim 1, wherein the gate is disposed on the sheet guidance member.

11. The apparatus according to claim 1, wherein, when the upper cover member is pivoted upward, a lock mechanism for an upper part of the main body and the upper cover member is unlocked by pulling the lever upward.

* * * * *